US008845147B1

(12) United States Patent
Ouellette

(10) Patent No.: US 8,845,147 B1
(45) Date of Patent: Sep. 30, 2014

(54) DIRECTABLE CLAMPING LIGHT STAND

(76) Inventor: Mark A. Ouellette, Victoria Harbour (CA)

( * ) Notice: Subject to any disclaimer, the term of this patent is extended or adjusted under 35 U.S.C. 154(b) by 215 days.

(21) Appl. No.: 13/606,660

(22) Filed: Sep. 7, 2012

(51) Int. Cl.
*F21V 21/00* (2006.01)

(52) U.S. Cl.
USPC ..... 362/396; 362/430

(58) Field of Classification Search
USPC ..... 362/190, 191, 217.14, 217.16, 396, 362/418, 430
See application file for complete search history.

(56) References Cited

U.S. PATENT DOCUMENTS

| | | | |
|---|---|---|---|
| 1,651,307 | A | 11/1927 | Wilkinson |
| 5,103,384 | A | 4/1992 | Drohan |
| 5,276,596 | A | 1/1994 | Krenzel |
| 5,823,658 | A | 10/1998 | Doddy |

*Primary Examiner* — Vip Patel
(74) *Attorney, Agent, or Firm* — Crossley Patent Law; Micah C. Gunn

(57) ABSTRACT

A directable clamping light stand able to be clamped to an extant object or surface, with an extant trouble lamp releasably clamped aloft a directable shaft, the directable shaft moveable between a plurality of positions, whereby the trouble lamp may be repositioned expediently, and securely supported in the plurality of positions, upon the directable shaft, as desired.

8 Claims, 2 Drawing Sheets

DIRECTABLE CLAMPING LIGHT STAND

BACKGROUND OF THE INVENTION

Various types of directable clamping light stands are known in the prior art. However, what is needed is a directable clamping light stand able to be clamped to an extant object or surface, with an extant trouble lamp releasably clamped aloft a directable shaft, the directable shaft moveable between a plurality of positions, whereby the trouble lamp may be repositioned expediently, and securely supported among the plurality of positions, upon the directable shaft, as desired.

FIELD OF THE INVENTION

The present invention relates to a directable clamping light stand, and more particularly, to a directable clamping light stand able to be clamped to an extant object or surface, with an extant trouble lamp releasably clamped aloft a directable shaft, the directable shaft moveable between a plurality of positions, whereby the trouble lamp may be repositioned expediently, and securely supported among the plurality of positions, upon the directable shaft, as desired.

SUMMARY OF THE INVENTION

The general purpose of the directable clamping light stand, described subsequently in greater detail, is to provide a directable clamping light stand which has many novel features that result in a directable clamping light stand which is not anticipated, rendered obvious, suggested, or even implied by prior art, either alone or in combination thereof.

As the owner of an automotive repair shop, I have many times witnessed a mechanic in the midst of repair work falter due to an awkwardly positioned trouble lamp, have to put down his tools to reposition or move the trouble lamp, wasting time and effort while working on the clock. What is needed is a directable clamping light stand able to be clamped to an extant object or surface, with a trouble lamp releasably clamped aloft a directable shaft, the directable shaft moveable between a plurality of positions, whereby the trouble light may be repositioned expediently, and securely supported among the plurality of positions, as desired.

The present directable clamping light stand includes a articulated metallic directable shaft having a first end and a second end. The articulated metallic directable shaft is rigidly tensile and tractable, yet able to support an extant trouble lamp aloft, as desired, among a plurality of positions. A first clamp member is disposed on the first end and a second clamp member is disposed on the second end of the directable shaft, the first clamp member configured to releasably attach around an extant trouble lamp, the second clamp member configured to releasably attach to a surface, or object, as desired.

The first clamp member includes a first jaw and a second jaw. The second jaw is pivotally attached to the first jaw. A first handle is attached to the first jaw and a second handle is attached to the second handle. The first handle connects the first clamp member to the first end of the directable shaft. A first spring member is disposed in the first clamp member, the first spring member compressibly forcing the first and second jaws together. When the first and second handles are squeezed together, the first spring member is compressed and the first and the second jaws open. When the first and second handle are released the first spring member forces the first and second handles apart, and the first and second jaws are closed.

The first jaw and the second jaw are generally semi-ovoid in shape, the first and second jaws configured to girdle an extant trouble lamp, a trouble lamp being typically cylindrical in shape. The first and the second jaws have a gripping surface disposed to contact the extant trouble lamp when said lamp is placed in the first clamp member. A plurality of teeth is disposed along the gripping surface to increase the purchase of the first clamp member with the trouble lamp. The trouble lamp is therefore securely positionable within the first clamp member and the trouble lamp will not slip, slide, or rotate, no matter what position the lamp is placed in.

The second clamp member includes a third jaw and a fourth jaw. The fourth jaw is pivotally attached to the third jaw. A third handle is disposed on the third jaw and a fourth handle is disposed on the fourth jaw. The third handle connects the second clamp member to the second end of the directable shaft. A second spring member is disposed in the second clamp member, the second spring member compressibly forcing the third and fourth jaws together. When the third and fourth handles are squeezed together, the second spring member is compressed and the third and the fourth jaw open. When the third and fourth handle are released the second spring member forces the third and fourth handle apart, and the third and fourth jaws are closed.

The second clamp member is releasably attachable to a surface or object by means of the second clamp member. When the second clamp member is attached to an object, the directable shaft projects from the third handle of the second clamp member, the directable shaft rigidly tensile and tractable, and the first clamp member is held aloft. The first clamp member may then be fitted with an extant trouble lamp, and the lamp positioned as desired. The second clamp member may be placed on a plurality of objects including, but by no means restricted to, a work bench, an undercarriage of a vehicle, a steering wheel, among others, and the directable clamping light stand moved, as desired, to direct light to a particular work area.

One in a desired position with the second clamp member releasably engaged with an extant object, the trouble lamp, positioned in the first clamp member, may be directed, as desired, by means of the directable shaft. The lamp may be raised, lowered, turned, or manipulated to illuminate a particular work area around a body of a person working in said area, as desired, with the lamp supported in the desired position upon the directable shaft.

Thus has been broadly outlined the more important features of the present directable clamping light stand so that the detailed description thereof that follows may be better understood and in order that the present contribution to the art may be better appreciated.

Objects of the present directable clamping light stand, along with various novel features that characterize the invention are particularly pointed out in the claims forming a part of this disclosure. For better understanding of the directable clamping light stand, its operating advantages and specific objects attained by its uses, refer to the accompanying drawings and description.

BRIEF DESCRIPTION OF THE DRAWINGS

Figures

DETAILED DESCRIPTION OF THE DRAWINGS

Figure 1:
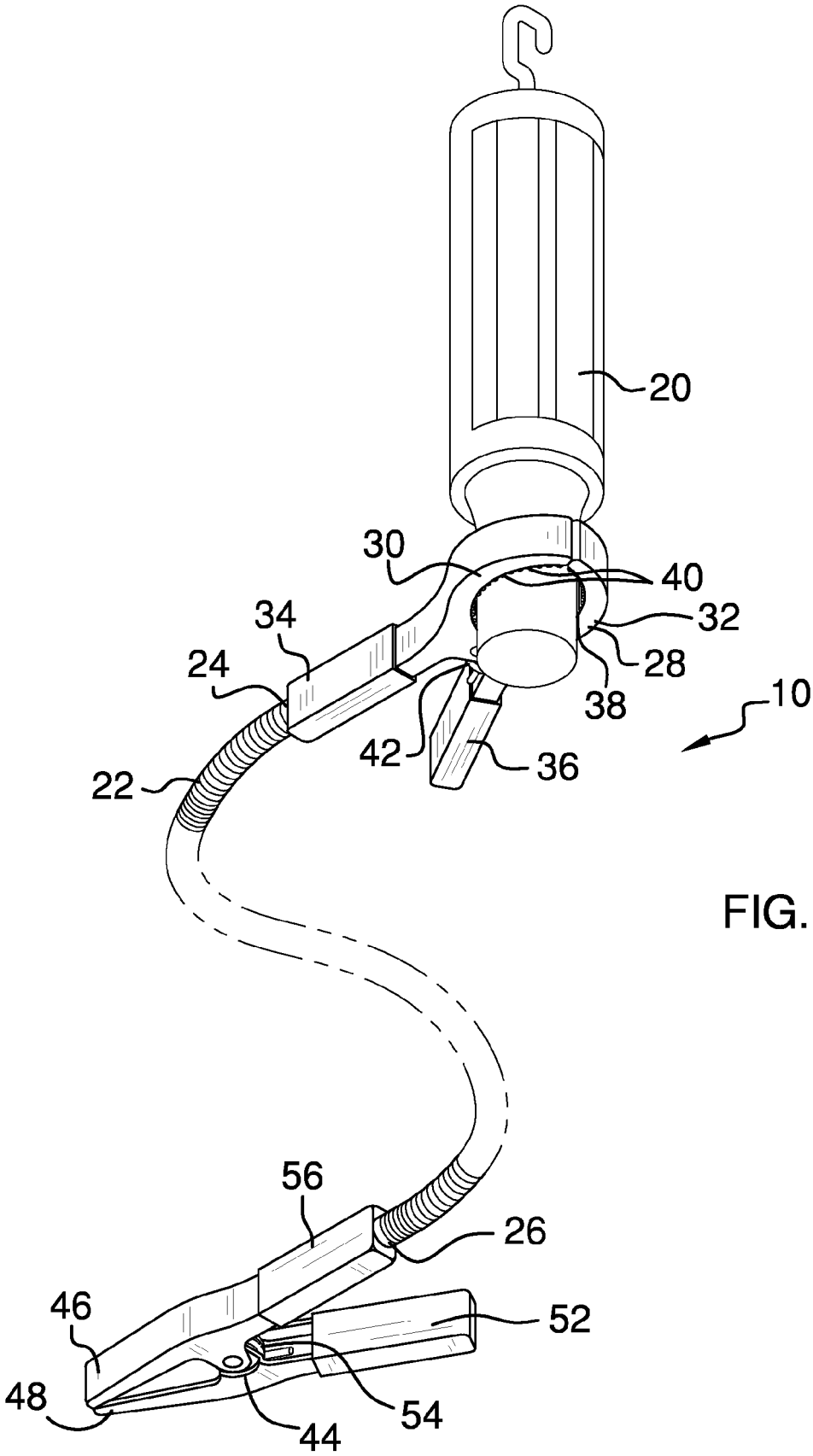
FIG. 1 is an isometric view.
Figure 2:
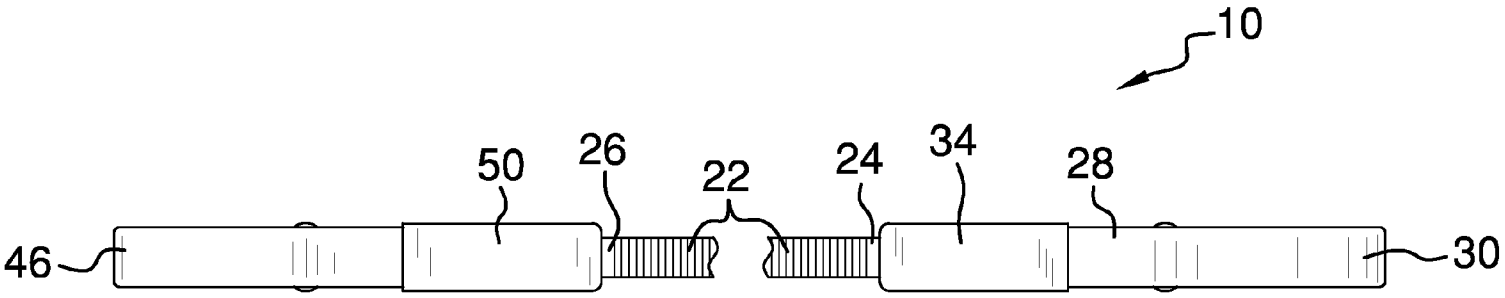
FIG. 2 is a top view.
Figure 3:
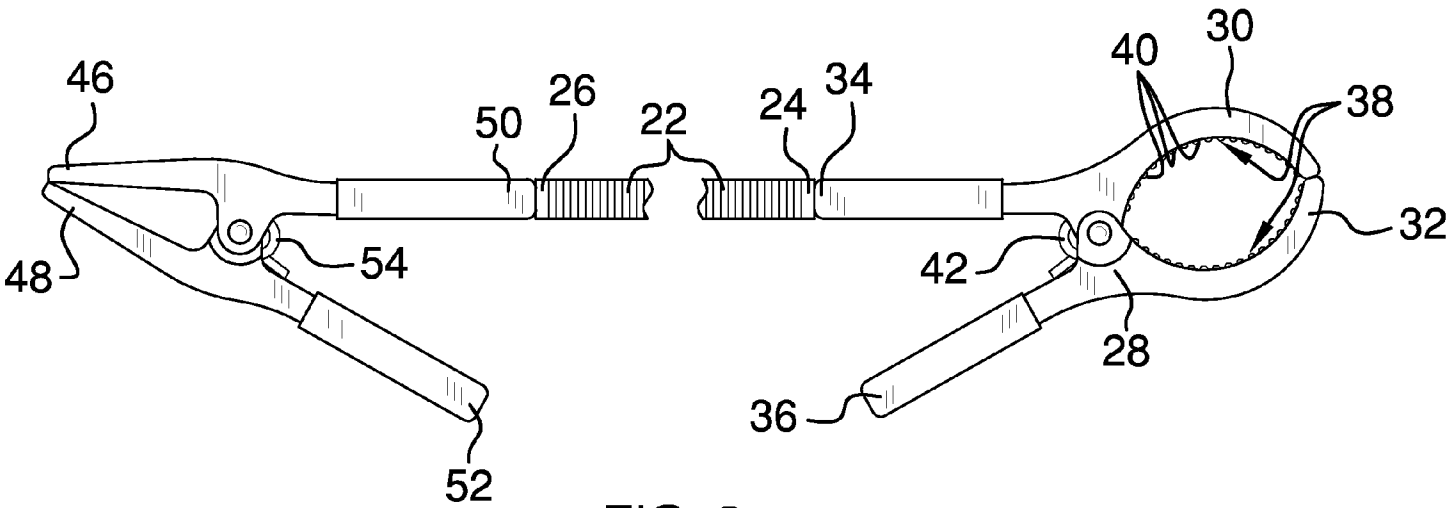
FIG. 3 is a side view.

With reference now to the drawings, and in particular FIGS. 1 through 3 thereof, example of the instant directable clamping light stand employing the principles and concepts of the present directable clamping light stand and generally designated by the reference number 10 will be described.

Referring to FIGS. 1 through 3 a preferred embodiment of the present directable clamping light stand 10 is illustrated.

The directable clamping light stand 10 is considered for use with an extant trouble lamp 20, or other flashlight, portable light, or lighting device. The directable clamping light stand 10 includes an articulated metallic directable shaft 22 having a first end 24 and a second end 26.

A first clamp member 28 is disposed on the first end 24 of the directable shaft 22. The first clamp member 28 includes a semi-ovoid first jaw 30, a semi-ovoid second jaw 32 pivotally attached to the first jaw 30, a first handle 34 attached to the first jaw 30, and a second handle 36 attached to the second jaw 32. The first handle 34 is disposed endwise from the first end 24 of the directable shaft 22. The first clamp member 28 is therefore attached to the directable shaft 22 by the first handle 34.

A gripping surface 38 is disposed on the inside of the first 30 and the second 32 jaws and a plurality of teeth 40 is disposed on the gripping surface 38 to increase the purchase of the first clamp member 28 around an extant trouble lamp 20 when the trouble lamp 20 is positioned in the first clamp member 28.

A first spring member 42 is disposed within the first clamp member 28, the first spring member 42 forcibly engaging the first jaw 30 and the second jaw 32 together. When the first handle 34 and the second handle 36 are squeezed together, the first 30 and second 32 jaws are opened and the first spring member 42 is compressed. When the first handle 34 and the second handle 36 are released, the first spring member 42 compressively forces the first 34 and second 36 handles apart and the first 30 and second 32 jaws are forced together. The first clamp member 28 is therefore releasably attachable to an object, and particularly an extant trouble lamp 20.

A second clamp member 44 is disposed on the second end 26 of the directable shaft 22. The second clamp member 44 includes a third jaw 46, and a fourth jaw 48 pivotally attached to the third jaw 46. A third handle 50 is attached to the third jaw 46 and a fourth handle 52 is attached to the fourth jaw 48. The third handle 50 is disposed endwise on the directable shaft 22 second end 26. The second clamp member 44 is therefore disposed upon the second end 26 of the directable shaft 22 by means of the third handle 50.

A second spring member 54 is disposed within the second clamp member 44, the second spring member 54 forcibly engaging the third jaw 46 and the fourth jaw 52 together when not compressed, as in the manner described previously for the first spring member 42.

The first clamp member 28 is larger than the second clamp member 44, the first jaw 30 and the second jaw 32 configured to releasably girdle and support an extant trouble lamp 20. The second clamp member 44 is configured to releasably attach to an extant object, such as a work surface, work bench, undercarriage of an automobile, or other object, as desired, when using the device 10 to direct and support an extant trouble lamp 20 to illuminate a desired area. Therefore, an extant trouble light 20 may be mounted to an object and directably supported thereupon by means of the directable clamping light stand 10, as desired.

What is claimed is:

1. A directable clamping light stand comprising:
- a directable shaft having a first end and a second end;
- a first clamp member disposed on the first end of the directable shaft, the first clamp member comprising:
  - a semi-ovoid first jaw;
  - a semi-ovoid second jaw pivotally attached to the first jaw;
  - a first handle attached to the first jaw;
  - a second handle attached to the second jaw;
  - a first spring member disposed within the first clamp member, the first spring member forcibly engaging the first jaw and the second jaw together;
- a second clamp member disposed on the second end of the directable shaft, the second clamp member comprising:
  - a third jaw;
  - a fourth jaw pivotally attached to the third jaw;
  - a third handle attached to the third jaw;
  - a fourth handle attached to the fourth jaw;
  - a second spring member disposed within the second clamp member, the second spring member forcibly engaging the third jaw and the second jaw together;
- wherein the first clamp member is larger than the second clamp member, the first clamp member configured to releasably engage and support an extant trouble light, the second clamp member configured to releasably attach to a extant object, whereby an extant trouble lamp may be mounted to an object and directably supported by means of the directable clamping light stand.

2. The directable clamping light stand of claim 1 wherein the first handle is attached to the first end of the directable shaft.

3. The directable clamping light stand of claim 2 wherein the third handle is attached to the second end of the directable shaft.

4. The directable clamping light stand of claim 3 wherein the first clamp member further comprises:
- an inner gripping surface disposed on each of the first and second jaws;
- a plurality of teeth disposed upon the inner gripping surface;
- wherein the plurality of teeth is configured to provide additional purchase upon an extant trouble lamp when said lamp is positioned in the first clamp member.

5. The directable clamping light stand of claim 4 wherein the directable shaft further comprises an articulated metallic shaft.

6. The directable clamping light stand of claim 5 wherein the directable shaft is approximately 24 inches in length.

7. The directable clamping light stand of claim 6 wherein the articulated metallic shaft is manufactured from steel.

8. A directable clamping light stand for use with an extant trouble lamp, the directable clamping light stand comprising:
- an articulated metallic, directable shaft having a first end and a second end;
- a first clamp member disposed on the first end of the directable shaft, the first clamp member comprising:
  - a semi-ovoid first jaw;
  - a semi-ovoid second jaw pivotally attached to the first jaw;
  - a first handle attached to the first jaw;
  - a second handle attached to the second jaw;
  - a gripping surface disposed on the inside of the first and the second jaws;
  - a plurality of teeth disposed on the gripping surface;
  - a first spring member disposed within the first clamp member, the first spring member forcibly engaging the first jaw and the second jaw together;
- a second clamp member disposed on the second end of the directable shaft, the second clamp member comprising:
  - a third jaw;
  - a fourth jaw pivotally attached to the third jaw;
  - a third handle attached to the third jaw;

a fourth handle attached to the fourth jaw;

a second spring member disposed within the second clamp member, the second spring member forcibly engaging the third jaw and the second jaw together;

wherein the first clamp member is larger than the second clamp member, the first clamp member configured to releasably engage and support an extant trouble light, the second clamp member configured to releasably attach to a extant object, and the directable shaft is positional to direct the trouble lamp as desired, whereby an extant trouble light may be mounted to an object and directably supported by means of the directable clamping light stand.

* * * * *